US011041362B2

(12) United States Patent
Parkins et al.

(10) Patent No.: US 11,041,362 B2
(45) **Date of Patent: *Jun. 22, 2021**

(54) PRODUCTION TUBING FLOW DIVERSION VALVE

(71) Applicant: GAS SENSING TECHNOLOGY CORP., Laramie, WY (US)

(72) Inventors: Jeffrey Parkins, Laramie, WY (US); Hugo Flores, Brisbane (AU)

(73) Assignee: GAS SENSING TECHNOLOGY CORP., Laramie, WY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/887,825

(22) Filed: May 29, 2020

(65) Prior Publication Data

US 2020/0291746 A1 Sep. 17, 2020

Related U.S. Application Data

(63) Continuation of application No. 15/755,003, filed as application No. PCT/US2016/047758 on Aug. 19, 2016, now Pat. No. 10,669,813.

(60) Provisional application No. 62/208,915, filed on Aug. 24, 2015.

(51) Int. Cl.
*E21B 34/08* (2006.01)
*E21B 43/12* (2006.01)

(52) U.S. Cl.
CPC ..... *E21B 34/08* (2013.01); *E21B 43/128* (2013.01)

(58) Field of Classification Search
CPC ..... E21B 34/08; E21B 43/128
See application file for complete search history.

(56) References Cited

U.S. PATENT DOCUMENTS

| | | | | |
|---|---|---|---|---|
| 7,753,111 | B1 * | 7/2010 | Reynolds | E21B 19/22 166/65.1 |
| 2007/0272403 | A1 * | 11/2007 | Robichaux | E21B 3/022 166/85.1 |
| 2008/0308270 | A1 * | 12/2008 | Wilson | E21B 41/02 166/244.1 |
| 2011/0005774 | A1 * | 1/2011 | Sinnott | E21B 23/02 166/380 |
| 2011/0259428 | A1 * | 10/2011 | Osborne | E21B 43/126 137/1 |
| 2015/0184487 | A1 * | 7/2015 | Osborne | E21B 43/126 166/373 |

* cited by examiner

*Primary Examiner* — Nicole Coy
*Assistant Examiner* — Yanick A Akaragwe
(74) *Attorney, Agent, or Firm* — Locklar PLLC

(57) ABSTRACT

A flow diversion valve comprising: a valve body including an upper housing releasably connected to a lower housing, the upper housing and lower housing being configured to receive a rotating rod therethrough; a shuttle positioned within the valve body, the shuttle being configured to move to cover one or more spill ports of the valve body; and a releasable locking member, wherein the releasable locking member is releasably connected to the valve body and positioned between the upper housing and the lower housing to assist in preventing relative movement therebetween.

17 Claims, 7 Drawing Sheets

PRODUCTION TUBING FLOW DIVERSION VALVE

CROSS-REFERENCE TO RELATED APPLICATIONS

This application is a continuation application that claims priority from U.S. patent application Ser. No. 15/755,003, filed Feb. 23, 2018, which is a National Stage Entry of PCT/US2016/047758, filed Aug. 19, 2016; which itself claims priority from U.S. provisional application No. 62/208,915, filed Aug. 24, 2015. The entireties of U.S. Ser. No. 15/755,003, PCT/US2016/047758 and U.S. 62/208,915 are incorporated herein by reference.

FIELD OF THE INVENTION

The present invention relates to a flow diversion apparatus. In particular, the invention relates, but is not limited, to a flow diversion valve for use with one or more submersible pumps in hydrocarbon producing wells to enable fluid within tubing positioned above the pumps to flow into the tubing annulus when pump operation ceases or there is a backflow of fluid down through the tubing.

BACKGROUND TO THE INVENTION

Reference to background art herein is not to be construed as an admission that such art constitutes common general knowledge.

In the extraction of hydrocarbon resources from beneath the earth's surface it is often necessary to overcome a low or negative pressure differential between the pressure of the hydrocarbon fluids in the reservoir pores and the hydrostatic head of that fluid in wells penetrating the reservoir from the surface. This is often achieved using a submersible pump that adds energy to a fluid to increase its flow rate and static pressure. Typical submersible pumps either employ downhole motors, such as electrical submersible pumps, or alternatively surface motors, such as reciprocating pumps and rotary progressive cavity pumps (PCP). Reciprocating and rotary pump types are activated by a rod string that is installed inside the production tubing.

In some embodiments, the pump is directly in line with the production tubing. When the pump shuts down, either planned or unplanned, fluid may flow back down the tubing and into the outflow port of the pump. This may occur until the level of fluid in the tubing equals that in the tubing annulus surrounding the tubing. In other situations, the pressure within the tube may increase, pushing fluid back down the tubing and into the pump. Whatever the cause, a reverse flow of fluid into the pump can cause mechanical damage. For example, the fluid may possibly cause spinning of the pump in reverse. The downward flow through the pump will also bring any solids entrained in the fluid back into the pump. Should this occur, the solids settle and pack in impellers and bearings and become impregnated in exposed elastomers, causing damage to the pump on later restarting, or cause the pump to seize completely if the torque required to turn the solids-laden pump exceeds the torque capacity of the drive motor. Also, at times, the tubing string or the pump can pack off or plug after a shut down. This may prevent flow back down the tubing. If the tubing does not drain, the operator may then have to bail out the production fluid before pulling the pump and tubing. Bailing involves running a bailer on a wireline repeatedly down into the tubing, taking time. This downtime can result in lost production and increased expenses for workmen and materials. Preventing solids from falling back into the pump is therefore desirable to prolong pump run life and reduce frequency of costly workovers.

One prior art approach is described in U.S. Pat. No. 6,289,990 awarded to D. B. Dillon et al, entitled "Production Tubing Shunt Valve", which describes apparatus and methods for preventing solids from falling back into electrical submersible pumps. However, the apparatus claimed does not include a passageway for a rod string through the centre of the Production Tubing Shunt Valve needed to operate and protect the progressive cavity pumps.

Another prior art approach is described in U.S. Pat. No. 8,545,190 awarded to Lawrence Osborne, which describes a shunt valve device that can be used with progressive cavity pumps, but which does not incorporate means for disassembly of the valve to replace damaged or worn parts and thus has a limited run life. Moreover, with ready means for disassembly, typically the potential for the valve to fail during use, particularly due to the torque induced along a flow string, is increased.

OBJECT OF THE INVENTION

It is an aim of this invention to provide a flow diversion (valve) apparatus which overcomes or ameliorate one or more of the disadvantages or problems described above, or which at least provides a useful alternative.

By way of example only, one objective of the present invention is to prevent or divert the buildup of solids in downhole submersible pumps, including progressive cavity pumps. Alternatively, or additionally, an objective of the present invention is to provide a flow diversion valve that can be fully cleaned, inspected and redressed between workovers to replace worn seals, fatigued closure mechanisms and corroded or eroded parts, and which is fluidly connected to the submersible pump, wherein the flow diversion valve automatically diverts hydrocarbons or other fluids and any entrained solids present in the production string above the pump away from the submersible pump outlet when pump operation is shutdown.

A further potential objective for the flow diversion valve actuator mechanism is to be resistant to abrasion by solids entrained in the fluid, reduce permanent pressure loss resulting from upward flow of the fluid past the actuator and include a means to enable the actuator mechanism to be retrieved using conventional fishing equipment should the rod string passing through the actuator become parted from the flow diversion valve.

Yet another potential objective is to provide a valve shuttle, actuator, etc., within the flow diversion valve contained within a multi-part housing.

Other preferred objects of the present invention are apparent from the following description.

SUMMARY OF INVENTION

A flow diversion valve comprising:

a valve body including an upper housing releasably connected to a lower housing, the upper housing and lower housing being configured to accommodate a rotating rod therethrough;

a shuttle positioned within the valve body, the shuttle being configured to move to cover one or more spill ports of the valve body; and a releasable locking member, wherein the releasable locking member is positioned between the upper housing and the lower housing to assist in preventing relative movement therebetween.

Preferably, the upper housing is threadingly connected to the lower housing. Normally, the upper housing is threadingly connected to the lower housing with the handedness of the threads being in the same direction as a torque generated by a pump. Typically, the upper housing is threadingly connected to the lower housing with a left-handed thread.

Preferably, the releasable locking member is releasably connected to the valve body. Typically, the releasable locking member assists in preventing the upper housing disengaging from the lower housing. Normally, the releasable locking member assists in preventing the upper housing sliding along the lower housing. Typically, the releasable locking member assists in preventing the lower housing moving in a downward direction.

Preferably, the releasable locking member includes a locking body. Preferably, the locking body has an aperture therein. Typically, the locking body includes two apertures extending therethough. Typically, the locking body is configured to be received into a locking aperture of the valve body. Normally, the locking aperture of the valve body is at least located in the lower housing. Preferably, the locking aperture extends between the lower housing to the upper housing. Typically, the locking aperture includes a threaded portion. Preferably, the threaded portion is located in the upper housing and/or the lower housing. In a further form, the locking body is in the form of a screw. In another form, the locking body forms a toggle clamp and/or a latch.

Preferably, detaching the upper housing from the lower housing allows access to valve components such as the shuttle, the spring and/or various seats and seals. This access allows, for example, the valve components to be cleaned, inspected and redressed. It also allows replacement of, for instance, worn, fatigued, corroded and/or eroded components as will be described below.

Preferably, the valve body is manufactured from heat, pressure and corrosion resistant alloys, such as stainless steel. Typically, the valve body is manufactured from high tensile steel. Preferably, the high tensile steel includes chromium-molybdenum (chromoly) steel. Normally, the valve body is manufactured from higher tensile material compared to the metallurgy of the production tubing adjacent thereto. Typically, the valve body material may be coated. Typically, the valve body can be made from combinations of the above. In a further form, preferably the valve body includes non-ferritic material.

Normally, the upper housing and the lower housing each include an aperture therethrough to accommodate the rotating rod. Typically, the apertures share the same longitudinal axis.

Preferably, the valve body includes one or more threaded connections that are configured to connect to production tubing. Normally, the one or more threaded connections include two threaded connections that are respectively located on the ends of the upper housing and the lower housing. Typically, the one or more threaded connections extend around an outside surface of the lower housing. Normally, the one or more threaded connections extend around an inside surface of the upper housing. Preferably, the one or more threaded connections are tapered. Normally, a torque ring is included between the production tubing and the one or more threaded connections. Typically, the torque ring is situated adjacent an end of the production tubing and next to the one or more threaded connections. Preferably, the torque ring is resiliently flexible. Preferably, the torque ring includes plastic. Preferably, the plastic is in the form of rubber.

Preferably, opening and/or closing of the one or more spill ports is controlled by movement of the shuttle and/or the actuator. Typically, the shuttle is a cylindrical shape body substantially matching the radius of the interior of the valve body. Normally, the upper end of the shuttle has one or more seats that correspond with one or more seats on the bottom of the actuator. Typically, a first seat is located on a first face (upper surface) of the shuttle and is for sealing against a first seat closure on a lower end of an actuator. Preferably, in response to the first seat closure of the actuator sealing against the first seat of the shuttle, fluid flow is directed out of the one or more spill ports.

Normally, a valve shuttle seat is located on the valve body. Typically, the valve shuttle seat is located on the upper housing. Preferably, a second seat is located on the shuttle for engaging the valve shuttle seat. Normally, the second seat is on an upper portion of the shuttle. Typically, in response to the second seat of the shuttle sealing against the valve shuttle seat, fluid flow is directed upwards along the flow diversion valve. Preferably, the aperture of the upper housing tapers inward from the top of the upper housing towards the valve shuttle seat.

Normally, the shuttle is biased by a spring that assists in moving the shuttle to cover the one or more spill ports of the valve body. Preferably, the spring is located substantially between a shuttle spring end and a valve body support. Normally, the valve body support is located beneath the second seat of the shuttle. Typically, the valve body support is in the form of a ledge. Preferably, the valve body support supports a bottom surface of the spring. Preferably, the valve body support does not support an internal surface of the spring. Preferably, the ledge is substantially L-shaped and is open to the apertures extending through the upper housing and/or lower housing such that the spring is not supported on the internal surface.

Normally, a valve center line is shared by the longitudinal axis of the apertures extending through the upper housing and lower housing, as well as the valve body, the shuttle, and/or the actuator.

Typically, the actuator has a bore for accepting the rotatable rod therethrough. Preferably, the actuator is for translating along the rotatable rod. Preferably, the rotatable rod is connected and supplies rotational power to a rotor in a submersible pump positioned beneath the flow diversion valve.

Preferably, the actuator includes a non-metallic sleeve. Preferably, the non-metallic sleeve is located on an inner portion of the actuator. Preferably, the non-metallic sleeve includes plastic. Preferably, the non-metallic sleeve includes a thermoplastic. Preferably, the thermoplastic includes poly ether ether ketone (PEEK). Preferably, in a further embodiment, the inner sleeve includes ceramic.

Preferably, the actuator includes an upper shell that is connected to a lower shell. Preferably, the upper shell is threadingly connected to the lower shell. Preferably, the non-metallic sleeve is located between the upper shell and the lower shell. Preferably, the non-metallic sleeve is situated inside the upper shell and the lower shell such that it is configured to slide over the rotating rod.

Preferably, the actuator includes a first conical shaped end and a second conical shaped end. Typically, the first conical shaped end is located on a lower portion of the actuator and the second conical shaped end is located on an upper portion of the actuator. Preferably, the first conical shaped end is tapered at a different angle to the second conical shaped end. Normally, the taper of the first conical shaped end is more inclined than the taper of the second conical shaped end. Preferably, the first conical shaped end includes the first seat closure.

Preferably, the actuator includes a ferromagnetic component. Preferably, the ferromagnetic component is a permanent magnet. Preferably, the ferromagnetic component is in the form of a ring. Preferably, the ring is magnetic.

Preferably, a spring is fitted on a top portion of the actuator. Preferably, the spring fitted on the top portion of the actuator acts as a shock absorber. Preferably, the spring fitted on the top portion of the actuator is configured to be positioned over the rotating rod. Preferably, in response to the actuator moving up and the spring impacting with a portion of the production string, the spring absorbs and dampen the shock impulse, thereby extending run life of the actuator and rod string.

Typically, in response to an upward flow moving through valve body, the spring extends the shuttle upward to cover the one or more spill ports. Preferably, in response to the upward flow moving through valve body, the actuator moves along the rotating rod above the valve body. That is, preferably the actuator is configured to leave the valve body in response to a sufficient upward flow moving through valve body. Preferably, the aperture extending through the upper housing is wider than the actuator to allow the actuator to move therethrough.

Preferably, in the event that pump operation is shutdown, the actuator slides down over the rotatable rod until it contacts the shuttle by means of the first seat closure. Preferably, in response to the first seat closure of the actuator sealing against the shuttle, the weight of fluid above the actuator then pushes the shuttle down, thereby exposing the one or more spill ports in the valve body. Preferably, in response to exposing the one or more spill ports in the valve body, there is a flow of fluid, and any entrained solids, out of the one or more spill ports away from a pump and into the well annulus.

Preferably, the rotating rod includes a coupling. Preferably, the coupling is located above the valve body. Preferably, the coupling includes a plastic covering. Preferably, the coupling includes an inner metal body with a thread. Preferably, the thread of the coupling is configured to be connected to pipe of the rotating rod adjacent thereto. Preferably, the coupling assists in stopping the actuator contacting an inner wall of the production tubing.

In a further form, the invention resides in a flow diversion valve comprising:

a valve body including an upper housing releasably connected to a lower housing, the upper housing and lower housing being configured to receive a rotating rod therethrough; and a shuttle positioned within the valve body, the shuttle being configured to move to cover one or more spill ports of the valve body, wherein the upper housing is threadingly connected to the lower housing with a left-handed thread.

Preferably, the flow diversion valve is as described herein.

In a further form, the invention resides in a flow management system, the system including:

production tubing having a rotating rod therein;

a flow diversion valve connected to the production tubing, the flow diversion valve comprising:

a valve body including an upper housing releasably connected to a lower housing, the upper housing and lower housing being configured to receive the rotating rod therethrough;

a shuttle positioned within the valve body, the shuttle being configured to move to cover one or more spill ports of the valve body; and a releasable locking member, wherein the releasable locking member is positioned between the upper housing and the lower housing to assist in preventing relative movement therebetween; and a pump connected to the flow diversion valve.

Preferably, the flow diversion valve is as described herein.

Preferably, production tubing includes a reinforced tube. Preferably, the reinforced tube connects directly to the flow diversion valve. Typically, the reinforced tube is in the form of a blast joint. Preferably, the reinforced tube includes a greater wall thickness relative to standard tubing used in the production tubing. Normally, the inner diameter of the reinforced tube substantially matches the inner diameter of standard tubing used in the production string.

Preferably, the pump is in the form of a progressive cavity pump. Preferably, the pump is configured to be submerged.

In a further form, the invention resides in a flow management system, the system including:

production tubing having a rotating rod therein; and a flow diversion valve connected to the production tubing, the flow diversion valve comprising:

a valve body including an upper housing releasably connected to a lower housing, the upper housing and lower housing being configured to receive a rotating rod therethrough;

a shuttle positioned within the valve body, the shuttle being configured to move to cover one or more spill ports of the valve body, wherein the upper housing is threadingly connected to the lower housing with the handedness of the threads being in the same direction as a torque generated by a pump that is connected to the flow diversion valve.

Preferably, the handedness of the threads is a left-handed thread.

Preferably, the flow management system is as described herein.

BRIEF DESCRIPTION OF THE DRAWINGS

The accompanying drawings, which are incorporated in and constitute a part of the specification, illustrate preferred embodiments of the disclosure. These drawings, together with the summary of the disclosure given above and the detailed description of the preferred embodiments given below, serve to explain the principles of the disclosure. By way of example only, preferred embodiments of the disclosure will be described more fully hereinafter with reference to the accompanying figures.

DETAILED DESCRIPTION OF THE DISCLOSURE

The disclosure provided in the following pages describes examples of some embodiments of the disclosure. The designs, figures, and description are non-limiting examples of certain embodiments of the disclosure. For example, other embodiments of the disclosed device may or may not include the features described herein. Moreover, disclosed advantages and benefits may apply to only certain embodiments of the disclosure and should not be used to limit the disclosure.

Figures 1, 2A, 2B:
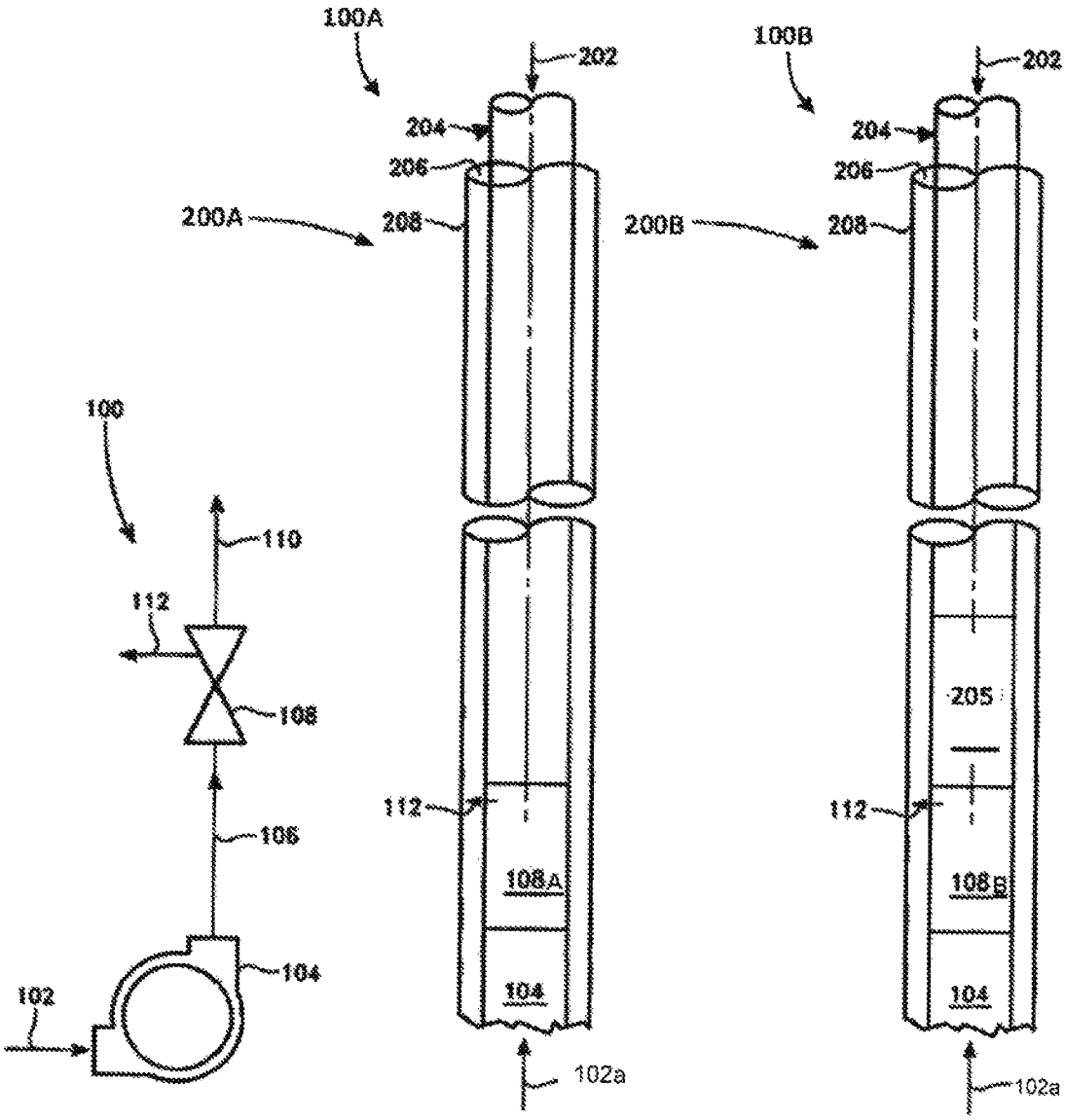
FIG. 1 is a schematic diagram of a flow diversion valve in a flow management system, according to an embodiment of the invention.
FIG. 2A is a diagram of the flow management system associated with FIG. 1 showing the (submersible) pump and a flow diversion valve connected to production tubing, according to an embodiment of the invention.
FIG. 2B is a diagram of a flow management system, according to a further embodiment of the invention.

To the extent parts, components and functions of the described disclosure exchange fluids, the associated interconnections and couplings may be direct or indirect unless explicitly described as being limited to one or the other. Notably, indirectly connected parts, components and functions may have interposed devices and/or functions known to persons of ordinary skill in the art FIG. 1 shows a schematic diagram of a flow management system 100, according to an embodiment of the invention, with a pump 104 connected to a flow diversion valve 108. The flow diversion valve 108 (hereinafter termed "diversion valve") is interconnected with the pump 104 via a pump outlet 106. The pump 104 is in the form of a progressive cavity pump (PCP) and includes a pump inlet 102. The diversion valve 108 includes a valve outlet 110 and a valve spill port 112. In various embodiments, the inlets, outlets and ports are one or more of a fitting, flange, pipe, or similar fluid conveyance. In the preferred embodiment, the pump 104 is located below the diversion valve 108.

FIG. 2A shows a section of a typical well 200A. A flow management system 100A in the well 200A includes a diversion valve 108A interposed between the pump 104 and production tubing 204. In some embodiments, a casing 208 surrounds one or more joints of the production tubing 204, diversion valve 108A, and pump 104. Here, an annulus 206 is formed between the production tubing 204 and the casing 208. A production flow is indicated by an arrow 102*a* while a backflow is indicated by an arrow 202. The diversion valve 108A of this disclosure serves to isolate backflows from one or more valves, portions of a valve, and the pump 104.

FIG. 2B shows a further well 200B. Similar to FIG. 2A, FIG. 2B shows a flow management system 100B with a diversion valve 108B interposed between the pump 104 and production tubing 204. In comparison to the flow management system 100A, the flow management system 100B includes production tubing 204 having a blast joint 205 above the diversion valve 108B. The blast joint 205 is discussed further below along with differences between the diversion valves 108A, 108B.

FIGS. 3A to 3D show an embodiment of the diversion valve 108A in the form of diversion valve 300A. The diversion valve 300A includes a valve body 324 comprising an upper housing 302 and a lower housing 303. The upper and lower housings 302, 303 of the diversion valve 300A are connected with threads 304 shown in FIGS. 3A and 3B. The threads 304 in this embodiment are left-handed threads. This use of screw threads with left-handedness assists in preventing the threads 304 from backing off as a consequence of torque induced through the diversion valve 300A by the operation of the pump 104.

Figure 3A:
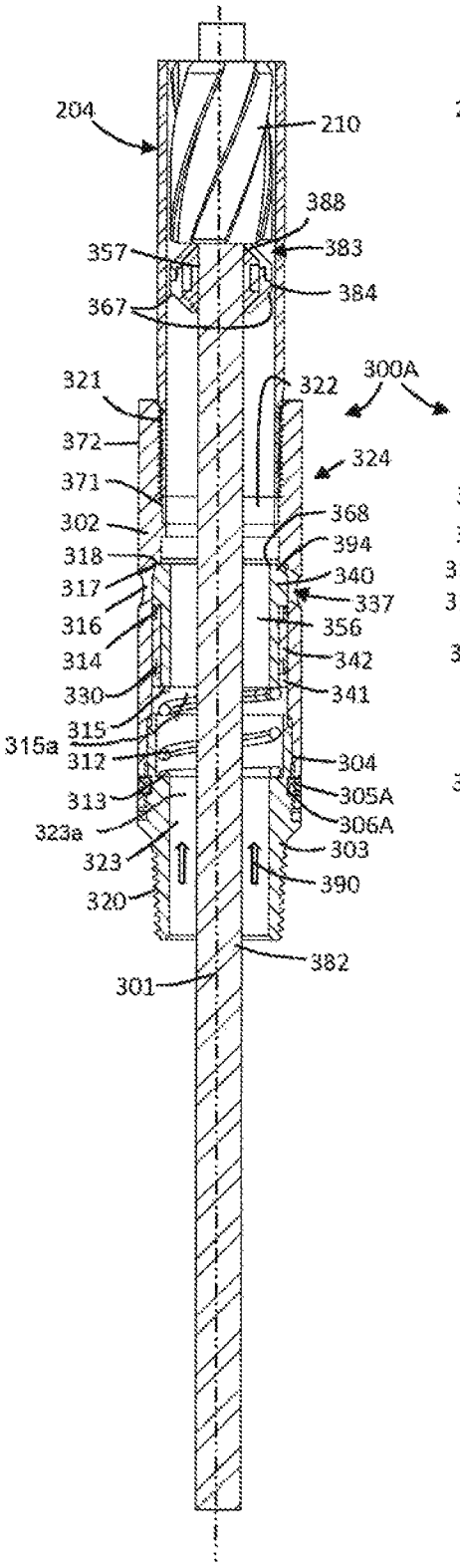
FIG. 3A is a cross-sectional view of the flow diversion valve of FIG. 2A, according to an embodiment of the invention, in a first configuration.
Figure 3B:
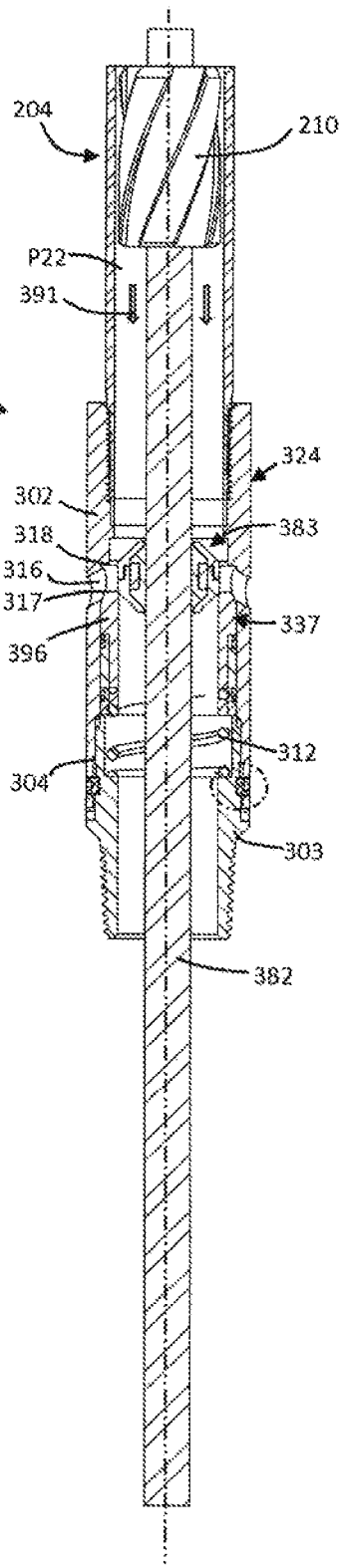
FIG. 3B is a cross-sectional view of the flow diversion valve of FIG. 2A, according to an embodiment of the invention, in a second configuration.

Separate threads exist on the connection 321 at top of upper housing 302. These threads can be of a female configuration on the interior surface of connection 321. These threads at the top of the upper housing 302 are compatible with the threads of the production tubing 204. As shown in FIGS. 3A and 3B, the connection between the production tubing 204 and upper housing 302 includes a torque ring 322. The torque ring 322 is situated adjacent an end of the production tubing 204 and next to the threads on the interior surface of the connection 321. The torque ring 322 is made from a rubber and assists in, amongst other things, increasing torsion capacity of the connection 321.

The threads 320 at the bottom of the lower housing 303 may be compatible with threads located at the top of the pump 104 assembly (see FIG. 2A). It will be appreciated that the threads will be of the same spacing and one thread segment will be of a female connection and the other segment will be of a male connection. This compatibility will eliminate the need for any special crossover pup joints above or below the diversion valve 300A, thereby simplifying installation and reducing costs. Furthermore, as appreciated from above, the connection between the lower housing 303 and pump 104 may also include a torque ring 322.

The valve body 324, accommodates components including a shuttle 337, an actuator 383, and a closing spring 312. In a further embodiment, the diversion valve 300A may include a shock absorbing spring (not shown) connected to the upper side of the actuator 383. It will be recalled that the actuator 383 can traverse up the rotatable rod 382, which is typically polished, under the influence of upward fluid flow 390.

Figure 3C:
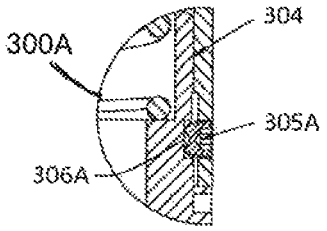
FIG. 3C illustrates a cross-sectional view of a locking member, according to an embodiment of the invention.

Turning to FIG. 3C, the diversion valve 300A includes a releasable locking member in the form of anti-rotation screws 305A. The anti-rotation screws 305A include an aperture in the form of a socket that receives a rotating tool (e.g. a hex key). The anti-rotation screws 305A respectively engage a locking aperture in the form of groove 306A in the lower housing 303. The combination of the anti-rotation screws 305A and groove 306A prevent the threads 304 from backing off as a consequence of torque induced through the diversion valve 300A by the operation of the pump 104 located below the diversion valve 300A. See FIG. 2A. In other embodiments, the valve body 324 may have a clam shell like construction wherein one side of the upper and lower housing 302, 303 of the valve body 324 is connected by a hinge like device and the other side detachably closed by an anti-rotation screw 305A, horizontal latch device, etc. The valve body 324 may also comprise more than two detachable sections.

Whenever the pump 104 and other equipment above it is retrieved from the well 200A, the upper housing 302 can be separated from the lower housing 303 by first removing the anti-rotation screws 305A and then unscrewing threads 304. The connecting surfaces of the upper and lower housing 302, 303 may contain seals and seats holding the seals in position. Suitable seal materials can include silicone rubber, elastomers, thermoplastic elastomers, and metals that are soft in comparison to the valve body 324, the selection depending, among other things, on the valve application. In an embodiment, the seals are made from ultra-high molecular weight polyethylene.

On separation of the two housings 302, 303 the shuttle 337 and closing spring 312 can be removed, dismantled, cleaned and inspected, with any worn, fatigued, corroded or eroded parts replaced. The diversion valve 300A can then be reassembled and re-used, thereby extending run life of the diversion valve 300A. This use of threads 304 and anti-rotation screws 305A eliminates the need to instead weld the upper housing 302 to the lower housing 303, which makes it impossible to subsequently dismantle and redress the device, preventing re-use if any of the internal parts are damaged.

The valve body 324 has a central chamber 323A. There is also a rotatable rod 382 that extends from the surface down the inside of the production tubing 204. The rotatable rod 382 passes through the central chamber 323A of the diversion valve 300A. The shuttle 337 is positioned within the valve body 324. The shuttle 337 includes an upper section 340, a centre sleeve 342 and a lower section 341. As shown in one figuration of FIG. 3A, the upper section 340 blocks the spill ports 316. The upper section 340 would be in this position when the fluid flow is upward fluid flow 390.

Upper and lower seals 314, 330 are fitted circumferentially to the centre sleeve 342 of the shuttle 337. In one embodiment, the seals have a curved cross-section such as a circular cross-section. In another embodiment, the seals have a rectangular cross-section (as shown in FIG. 3A).

Figure 4:
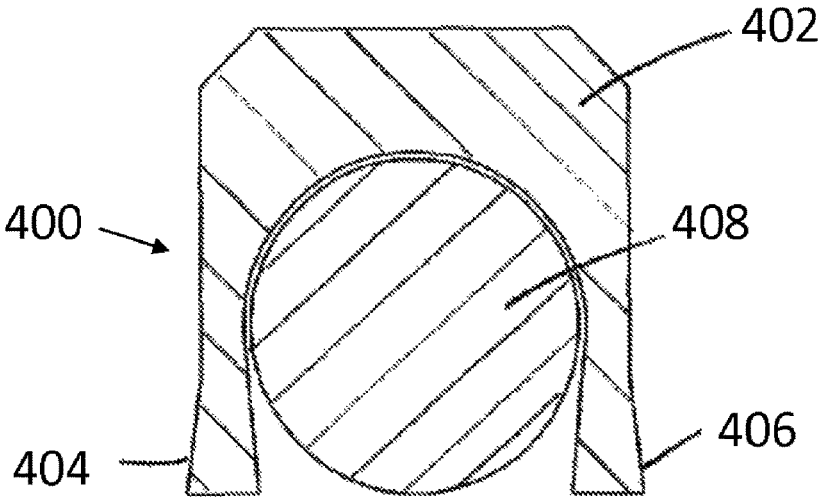
FIG. 4 is a cross-sectional view of a seal of the flow management system, according to an embodiment of the invention.

In some embodiments, one or more seals 314, 330 have a structure 400 similar to that shown in FIG. 4. Here, a seal body 402 such as a polymeric body, has inner and outer lip seals 406, 404 and substantially envelops a charge O-ring or energizing spring 408 such as a silicon rubber ring, or metal spring. In various embodiments, the seals 314, 330 are made from one or more of a rubber, plastic, metal, or another suitable material known to persons of ordinary skill in the art. For example, seal materials include silicone rubber, elastomers, thermoplastic elastomers, and metals that are soft in comparison to the valve body 324, the selection depending on, among other things, the valve application. In an embodiment, the seals are made from ultra-high molecular weight polyethylene.

The shuttle and actuator 337, 383, have through-holes 356, 357 (i.e. a bore). The rotatable rod 382 pass through the through-holes 356, 357. As outlined above, there is typically a chrome-plated or similar polished surface included on the rotatable rod 382. A purpose of the chrome-plated polished rod is to limit the friction acting on the through hole 357 of the actuator inner sleeve 388, as it traverses along the rotatable rod 382.

A first face of the valve shuttle in the form of a first seat 368 is for sealing against a first (conical) actuator sealing face 367 of the actuator 383. In an embodiment, the first seat 368 is near an upper end of the upper section 340 of the shuttle 337 and the first actuator sealing face 367 is near a lower end of the actuator 383. In some embodiments, the first seat 368 is about radially oriented with respect to the valve body centre line 301. In various embodiments, the shuttle sealing face (i.e. first seat 368) is integral with or coupled to the shuttle 337. And, in various embodiments, the actuator sealing face 367 (i.e. the actuator sealing face) is integral with or coupled to the actuator 383.

The design of actuator 383 may have a conical or tapered lower section to reduce permanent pressure loss resulting from upward flow of fluid around it. Furthermore, the upper section or surface of the actuator 383 is conical to reduce erosion of the actuator 383 by particle impingement of any solids entrained in back flowing fluid. In a preferred embodiment, the apex angles of the upper and lower conical sections are different.

In the embodiment shown in FIGS. 3A and 3B, the actuator 383 has a conical actuator sealing face 367 to reduce permanent pressure loss resulting from upward flow of fluid around it. The upper surface of the actuator 383 also has a conical shape. In further embodiments, the taper of the upper surface of the actuator 383 may be shallower, relative to the conical sealing face 367, and have a greater length to reduce turbulence in the upward flow.

The actuator 383 may further comprise threaded components. This is shown in the further embodiment of actuator 500 in FIG. 5. The upper and lower threaded components (or shells) are shown as items 501 and 502. See also FIGS. 6 and 7. The threaded components allow the actuator 383, 500, 600, 700 to be disassembled. As discussed below, a ferrite material may be placed within the interior of the actuator 383, 500, 600, 700. This ferro-magnetic material may facilitate recovery of the actuator in the event that the rotatable rod 382 breaks.

A second face (or portion) in the form of second seat 317, on the upper section 340 of shuttle 337, is for sealing against a face of the valve body 324 above the spill ports 316. The face of the valve body 324 is in the form of valve shuttle seat 318. In an embodiment, the valve shuttle seat 318 is near an upper section of the upper housing 302 of valve body 324. In some embodiments, the valve shuttle seat 318 is about radially oriented with respect to the valve body centreline 301. In various embodiments, the second seat 317 of the shuttle 337 is integral with or coupled to the shuttle 337. And, in various embodiments, the valve shuttle seat 318 is integral with or coupled to the valve body 324.

As indicated above, radially arranged and located on the upper housing 302 of valve body 324 are one or more spill ports 316. Each spill port 316 extends between inner and outer walls 371, 372 of the valve body 324. The inner wall 371 of the valve body 324 tapers inwardly towards the valve shuttle seat 318.

Inducing upward movement of the shuttle 337 is the closing spring 312. In various embodiments, the closing spring 312 is seated about radially oriented with respect to the valve body centreline 301 and is seated on a valve body support 313. In the embodiment shown in FIGS. 3A and 3B, an upper end of the closing spring 315 presses against an underside of a lower section 341 of the shuttle 337. This lower section 341 is known as the shuttle spring end.

It will be appreciated that it will be important for the area or diameter of the annulus 323 be as wide as feasible to facilitate production flow.

In the embodiments shown, the spring 312 is positioned in close proximity to the interior wall of the valve body 324. In further embodiments, an outer edge of the cylindrical coil spring 312 may be in contact with the interior surface. The spring 312 is not positioned or supported with an interior partition. This configuration is utilized in part to maximize the radial space or annulus, 323, and through-hole 356 between the rotatable rod 382 and the interior of the valve wall.

Similarly, the shuttle 337 is constructed so the seat of the widely positioned spring 312 (having a wide radius) and shuttle spring end lower section 341, also having a maximum radius, meet at or proximate to their interior edges 315A. This meeting of components having wide radii provides maximum diameter to the annulus containing fluid. In further embodiments, the outer surface of the shuttle 337 may be in contact with at least a portion of the valve body 324 interior surface. The outer surface of the shuttle 337 and spring 312 may be coated with a non-friction, high temperature resistant substance such as Molykote available from Dow Corning. This is a bonding, dry-film lubricant typically containing $MoS_2$ graphite or PTFE.

The resulting widened space within the valve body 324 can decrease the flow resistance for the pump 104, thereby increasing the pump life. It also decreases the erosion potential of solids-laden fluid through the diversion valve 300A, thereby minimizing wear of the components of the diversion valve 300A.

Operation of the diversion valve 300A includes rotation of the rotatable rod 382 which is normally the means of operating the pump 104. In normal operation, forces on the shuttle 337 and actuator 383 determine their position. When the pump 104 is lifting fluid within the tubing and within a designed flow-rate range, the shuttle 337 rises to its uppermost position 394 under the influence of the closing spring 312 and the rising fluid lifts the actuator 383 free of the shuttle 337 to a higher position 384 on the rotatable rod 382. Notably, in its uppermost position, the shuttle 337 blocks the spill ports 316 when the second seat 317 seals with the valve shuttle seat 318. Furthermore, the actuator 383 typically leaves the valve body 324 under the influence of the lifting fluid. This is shown in FIG. 3A. In addition, the actuator 383 may be stopped along the rotatable rod 382, above the valve body 324, with the coupling 210. The coupling 210 includes an inner metal body with a thread that connects the rotatable rod 382 with additional rods extending from the surface. An outer plastic covering with centralizing vanes, which maybe spiral, also surrounds the inner metal body of the coupling 210.

It will be appreciated that the fluids and any entrained solids discharged from the pump 104 flows through the bore of the diversion valve lower housing 303 and shuttle 337 which is blocking the spill ports 316. The fluids emerge through the aperture at the top of the upper housing 302 and continue up into the production tubing above.

When the pump 104 ceases to lift fluid at a sufficient rate, as with back-flow 391, the actuator 383 falls to contact the shuttle 337. This causes the actuator sealing face 367 to seal with the first seat 368 of the shuttle 337. Further, if the force P22 resulting from the pressure above the first seat 368 overcomes the force of the closing spring 312 and the force resulting from the pressure below the actuator 383, the shuttle 337 is pushed down to position 396 and the spill port(s) 316 are unblocked allowing fluid in the tubing above the diversion valve 300A to spill outside the diversion valve 300A, for example into annulus 206 between the production tubing 204 and the casing 208.

It will be appreciated that the interior radius of the upper housing 371 may be larger than the internal radius of the housing including the cylindrical shape of the shuttle 337. Further the external radius of the shuttle 337 is greater than the radius of the actuator sealing face 367 of the actuator 383. This size differentiation results in the configuration of the actuator 383 seating against the first seat 368 of the shuttle 337 and allows the spill ports 316 to open.

From the above, it can be seen that insufficient fluid flow, no fluid flow, or reverse fluid flow causes the diversion valve 300A and the pump 104 to be removed from the fluid circuit and/or isolated from the fluid column above the shuttle 337. A benefit of this isolation is protection of the diversion valve 300A and the pump 104. One protection afforded is protection of the diversion valve 300A and pump 104 components from solids, normally rising with the fluid but now moving toward the diversion valve 300A and the pump 104, that might otherwise foul or block one or both of the diversion valve 300A or pump 104. Blocking the flow path around the shuttle 337 and opening the spill ports 316 removes these solids outside the diversion valve 300A.

Figure 3D:
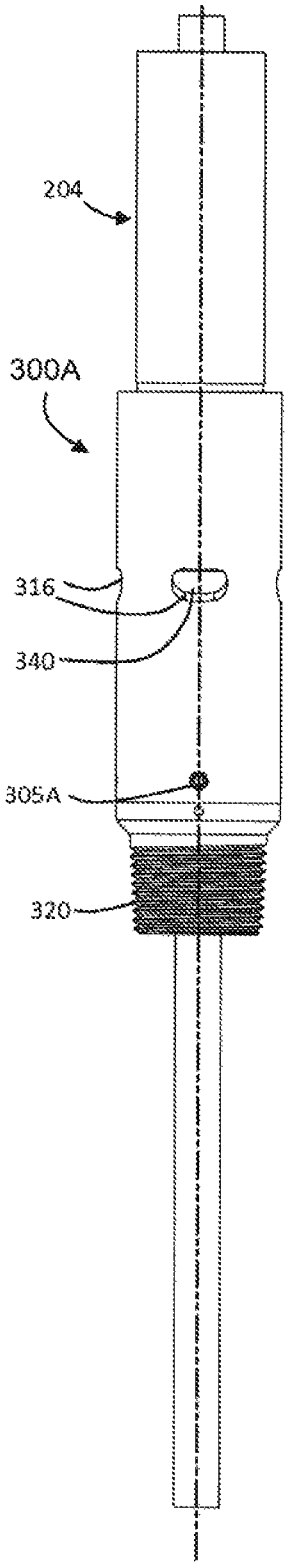
FIG. 3D illustrates an exterior view of a valve body in FIGS. 3A and 3B showing multiple spill ports and the spill ports closed by the positioning of a valve shuttle, according to an embodiment of the invention.

FIG. 3D illustrates an exterior view of the diversion valve 300A. Shown are the screw threads 320 connecting the diversion valve 300A to the pump 104. Also shown are the spill ports 316 and the upper section 340 of the shuttle 337. Also shown are the anti-rotation screws 305A.

Figure 5:
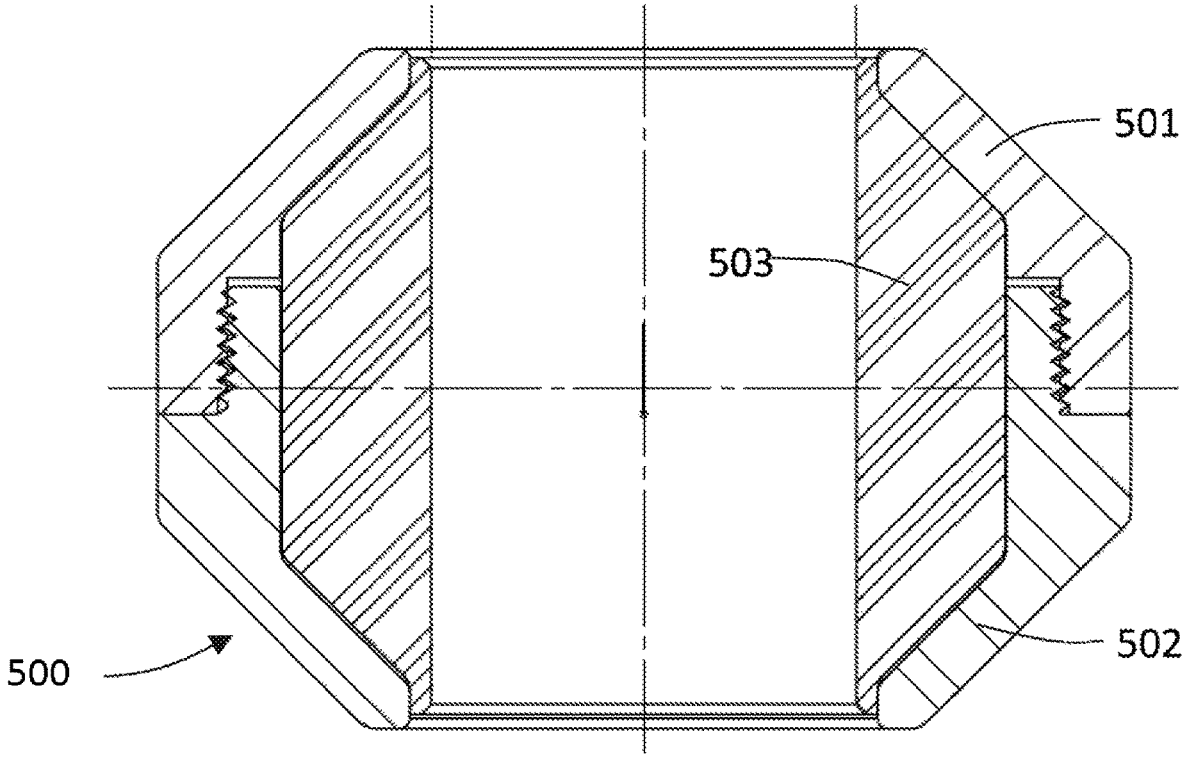
FIG. 5 is a cross-sectional view of an actuator, according to an embodiment of the invention.

FIG. 5 shows one embodiment of the actuator 500 comprising an upper metal shell 501 and a lower metal shell 502 encapsulating a non-metallic inner sleeve 503. The metal shells 501, 502 are treated using processes such as electroless nickel plating or quench polish quench (QPQ) liquid nitriding to confer improved corrosion and surface hardness. The improved surface hardness boosts abrasion resistance from impingement of solids entrained in the fluids passing around the actuator 500 (or 383). The use of a non-metallic material for the inner sleeve 503 ensures the actuator 500 will not seize on the rotatable rod 382. For downhole applications thermoplastics such as polyether ether ketone (PEEK), or ceramics, are ideally suited for non-metallic parts as they are mechanically and chemically stable at prevailing in-situ conditions, and can be used with injection moulds. The actuator 500 is assembled by sandwiching the sleeve 503 between the upper and lower metal shells 501, 502 and screwing these two parts together. The advantage of this split shell design is that it enables the inner sleeve 503 to be fabricated in a separate injection mould or machined from raw stock materials, greatly simplifying overall construction of the actuator 500, and enables parts to be independently replaced if worn or damaged, rather than having to replace the entire assembly, thereby reducing costs. The shape of the actuator 500 is depicted in a cross sectional view. The shape can be described as a double conical shape or cross sectionally as a rhomboid, being a parallelogram in which adjacent sides are of unequal lengths and angles are not right angles.

In the eventuality that the rotatable rod 382 parts, twists, deforms or separates below the diversion valve 300A, the rotatable rod 382 above the break is pulled from the well, causing the actuator 383 to rest against the shuttle 337. The oblique positioning of the actuator within the valve body 324 greatly hinders recovery of the remaining section of the rotating rod in the well that is attached to the rotor located in the pump 104.

Figure 6:
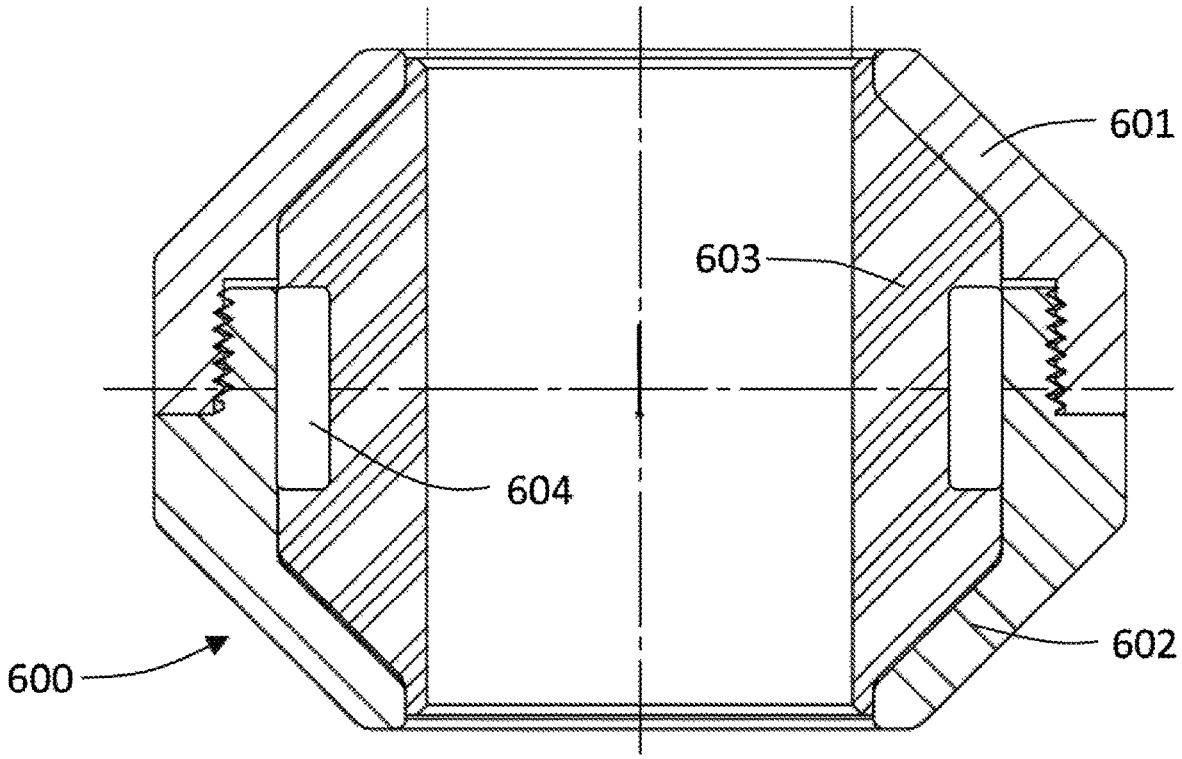
FIG. 6 is a cross-sectional view of an actuator with a ferrite core, according to a further embodiment of the invention.

FIG. 6 shows an alternative actuator 600 embodiment which also encompasses an upper and lower metal shell 601, 602, an inner non-metallic sleeve 603 and also includes a magnetic ring 604. This ring 604 is made from a ferromagnetic material, such as alnico or samarium cobalt, that can be suitably plated or coated (examples: nickel plated, epoxy coated, parylene coated) to confer additional corrosion resistance.

Using the magnetic properties of the magnetic ring 604, the actuator 600 can then be retrieved using a skirted and bar fishing magnet that can be deployed on slickline inside the production tubing. The strong magnetic attraction between the bar magnet and the ferromagnetic ring 604 in the actuator 600 overcomes gravitational pull and viscous drag on the actuator 600, enabling it to be retrieved to the surface.

Successful retrieval of the actuator 600 then provides access for standard fishing equipment to retrieve the remaining part of the rotatable rod 382 left in the well that will be attached to the PCP rotor located inside pump 104. The PCP rotor can then be re-deployed on a new rotatable rod 382, thereby avoiding a costly well workover, involving mobilisation of a drilling or workover rig, to retrieve the production tubing 204 and pump 104.

Figure 7:
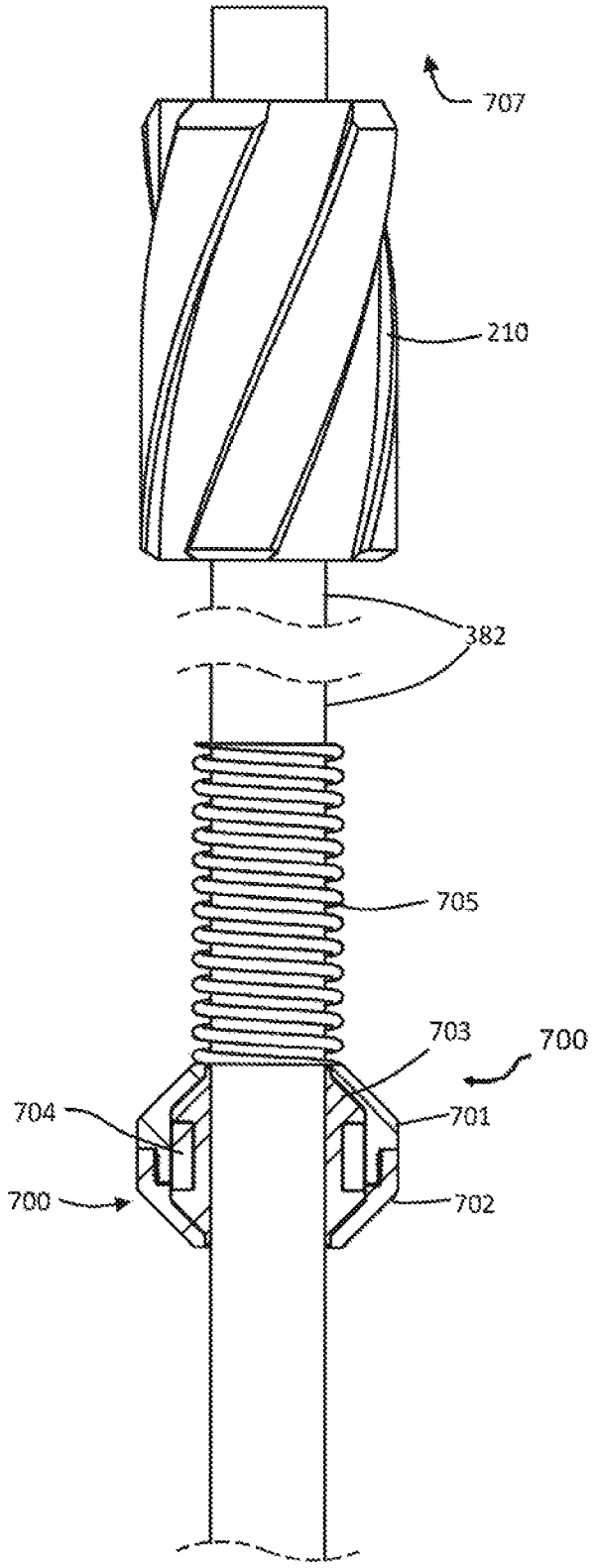
FIG. 7 is a cross-sectional view of an actuator with a ferrite core and spring shock absorber, according to a further embodiment of the invention.

FIG. 7 shows yet another embodiment of an actuator 700 that has a spring shock absorber 705 on top. Actuator 700 encompasses an upper and lower metal shell 701, 702, an inner non-metallic sleeve 703 and also includes a magnetic ring 704. This is positioned over the rotatable rod 382 that passes through the centre of the actuator 700 and flow diversion valve 300A. The rotatable rod 382 comprises multiple individual rods (including the polished rod) that are screwed together with the coupling 210, which has a larger diameter than the rod body. When the actuator 700 moves up the rotatable rod 382 under the action of flow moving around it, there is potential for the actuator 700 to impact the rod coupling 210, imparting a high impulse force, otherwise known as shock load. Repeated impacts can obviously lead to mechanical fatigue of either the actuator 700, rod coupling 210, or both. The purpose of the spring shock absorber 705 is to absorb and dampen the shock impulse, thereby extending run life of the actuator 700 and rotatable rod 382.

The actuator embodiments shown in FIG. 5, FIG. 6 and FIG. 7 may have rhomboid geometries top and bottom. This tapered profile has the benefit of limiting extent of turbulent eddies created in the fluid as it flows through the annular restriction around the actuator, thereby reducing energy dissipation. This will in turn reduce permanent pressure loss, also referred to as irreversible pressure loss. The tapered geometries of the upper and lower metal shells will therefore also provide the additional benefit of limiting impact on head efficiency created by the pump 104.

Figure 8C:
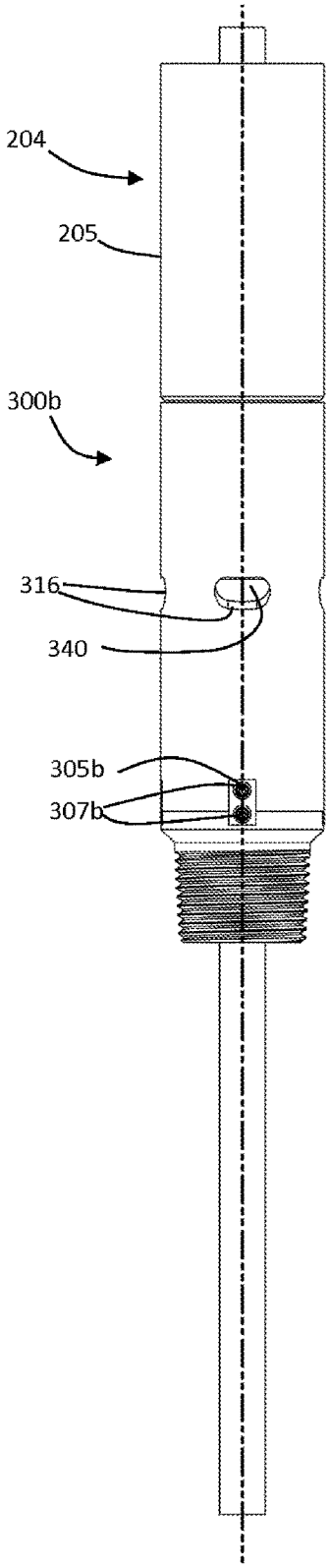
FIG. 8C illustrates an exterior view of a valve body in FIG. 8A showing multiple spill ports and the spill ports closed by the positioning of a valve shuttle, according to a further embodiment of the invention.
Figure 8A:
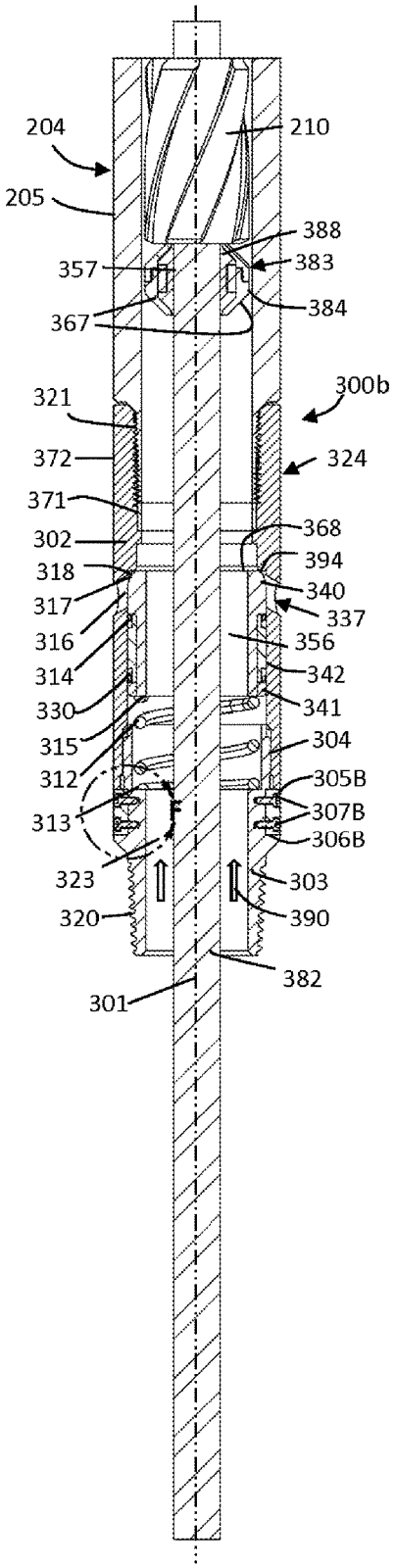
FIG. 8A is a cross-sectional view of the flow diversion valve of FIG. 2B, according to an embodiment of the invention, in a first configuration.
Figure 8B:
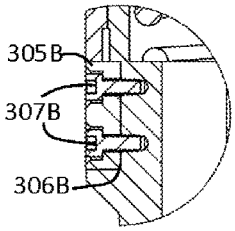
FIG. 8B illustrates a cross-sectional view of a locking member, according to a further embodiment of the invention.

It should be evident to those skilled in the art that the designs shown in actuator embodiments FIG. 5, FIG. 6 and FIG. 7 can be combined to provide an actuator than has a top shock absorber but no internal ferromagnetic ring FIGS. 8A to 8C show an embodiment of the diversion valve 108B in the form of diversion valve 300B. The diversion valve 300B is substantially the same as diversion valve 300A and, therefore, like numbering has been used. However, the diversions valve 300B includes the following notable differences.

As further shown in FIG. 8B, the diversion valve 300B includes a locking member having a locking body 305B that is substantially rectangular. The locking body 305B includes two apertures therethrough. A locking aperture 306B in the form of two threaded holes is located in the lower housing 303. The locking aperture 306B extends outward to form a ledge in the lower housing 303. The locking body 305B is received between the ledge and the upper housing 302. Two fasteners 307B extend through the two apertures of the locking body 305B and are connected to the two threaded holes to releasably connect the locking member to the valve body 324. Multiple locking members are equally spaced around the valve body 324. In a preferred embodiment four locking members are incorporated. When the locking members are in place, they assist in preventing the threads 304 from backing off as a consequence of torque induced through the flow diversion valve 300B during assembly of the flow diversion valve 300B with the pump 104 and the production tubing 204, during operation of the pump 104 and during removal of the flow diversion valve 300B from between the pump 104 and production tubing 204.

In comparison to the flow management system 100A, the production tubing 204 of the flow management system 1008, above the diversion valve 300B, includes a blast joint 205. The blast joint 205 has an inner diameter that is the same as the standard tubing used in the production tubing 204 thereabove. However, the blast joint includes a greater wall thickness relative to standard tubing. In this regard, the production tubing is a reinforced tube that connects directly to the diversion valve 300B. The blast joint 205, by virtue of having a greater wall thickness, can withstand greater wear caused by any potential rubbing between the actuator 383 and the inner wall of the blast joint 205.

As can be appreciated from FIGS. 8A and 8C, with the use of the shuttle 337 and actuator 383, the opening and closing of the spill ports 316 in the diversion valve 300B is the same as diversion valve 300A.

This specification is to be construed as illustrative only and is for the purpose of teaching those skilled in the art the manner of carrying out the disclosure. It is to be understood that the forms of the disclosure herein shown and described are to be taken as the presently preferred embodiments. As already stated, various changes may be made in the shape, size and arrangement of components or adjustments made in the steps of the method without departing from the scope of this disclosure. For example, equivalent elements may be substituted for those illustrated and described herein and certain features of the disclosure maybe utilized independently of the use of other features, all as would be apparent to one skilled in the art after having the benefit of this description of the disclosure.

While specific embodiments have been illustrated and described, numerous modifications are possible without departing from the spirit of the disclosure, and the scope of protection is only limited by the scope of the accompanying claims.

This specification is to be construed as illustrative only and is for the purpose of teaching those skilled in the art the manner of carrying out the invention. It is to be understood that the forms of the invention herein shown and described are to be taken as the presently preferred embodiments. As already stated, various changes may be made in the shape, size and arrangement of components or adjustments made in the steps of the method without departing from the scope of this invention. For example, equivalent elements may be substituted for those illustrated and described herein and certain features of the invention maybe utilized independently of the use of other features, all as would be apparent to one skilled in the art after having the benefit of this description of the invention.

While specific embodiments have been illustrated and described, numerous modifications are possible without departing from the spirit of the invention, and the scope of protection is only limited by the scope of the accompanying claims.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

In this specification, the terms 'comprises', 'comprising', 'includes', 'including', or similar terms are intended to mean a non-exclusive inclusion, such that a method, system or apparatus that comprises a list of elements does not include those elements solely, but may well include other elements not listed.

What is claimed is:

1. A flow management system, the system including:
production tubing having a rotating rod therein;
a flow diversion valve connected to the production tubing, the flow diversion valve comprising:
a valve body including an upper housing releasably connected to a lower housing, the upper housing and lower housing being configured to receive the rotating rod therethrough;
a shuttle positioned within the valve body, the shuttle being configured to move to cover one or more spill ports of the valve body;
a releasable locking member, wherein the releasable locking member is positioned between the upper housing and the lower housing to assist in preventing relative movement therebetween;
wherein an actuator is configured to seal against a first seat of the shuttle in order to direct fluid flow out of the one or more spill ports and wherein the actuator includes a non-metallic sleeve located on an inner portion of the actuator; and
a spring fitted on a top portion of the actuator; and
a pump connected to the flow diversion valve;
wherein the shuttle is biased by a spring that assists in moving the shuttle to cover the one or more spill ports of the valve body.

2. The flow management system of claim 1, wherein the upper housing is threadingly connected to the lower housing.

3. The flow management system of claim 1, wherein the upper housing is threadingly connected to the lower housing with a left-handed thread.

4. The flow management system of claim 1, wherein the releasing locking member includes a locking body having an aperture therein.

5. The flow management system of claim 4, wherein the aperture extends through the locking body.

6. The flow management system of claim 4, wherein the locking body is configured to be fixed to a locking aperture of the valve body.

7. The flow management system of claim 6, wherein the locking aperture includes a threaded portion.

8. The flow management system of claim 6, wherein the locking aperture extends between the lower housing and the upper housing.

9. The flow management system of claim 1, wherein the valve body is manufactured from high tensile steel.

10. The flow management system of claim 1, wherein the valve body includes one or more threaded connections that are configured to connect to production tubing.

11. The flow management system of claim 1, wherein the actuator has a bore for accepting the rotatable rod therethrough.

12. The flow management system of claim 1, wherein the actuator includes a first conical shaped end and a second conical shaped end.

13. The flow management system of claim 12, wherein the first conical shaped end is tapered at a different angle to the second conical shaped end.

14. The flow management system of claim 1, wherein the actuator includes a ferromagnetic component.

15. The flow management system of claim 1, wherein in response to an upward fluid flow moving through the valve body, the actuator moves along the rotating rod above the valve body.

16. The flow management system of claim 1, wherein the production tubing includes a reinforced tube having a greater wall thickness relative to other tubing used in the production tubing.

17. A flow management system, the system including:
production tubing having a rotating rod therein;
a flow diversion valve connected to the production tubing, the flow diversion valve comprising:
a valve body including an upper housing releasably connected to a lower housing, the upper housing and lower housing being configured to receive the rotating rod therethrough;
a shuttle positioned within the valve body, the shuttle being configured to move to cover one or more spill ports of the valve body;
a releasable locking member, wherein the releasable locking member is positioned between the upper housing and the lower housing to assist in preventing relative movement therebetween;
wherein an actuator is configured to seal against a first seat of the shuttle in order to direct fluid flow out of the one or more spill ports; and
a spring fitted on a top portion of the actuator; and
a pump connected to the flow diversion valve;
wherein the rotating rod includes a coupling that assists in stopping movement of the actuator after it has moved above the valve body.

* * * * *